United States Patent [19]

Eichinger et al.

[11] 4,278,028

[45] Jul. 14, 1981

[54] RESILIENT RAILWAY TRUCK ARTICULATED SHAFT HOUSING

[75] Inventors: Hans Eichinger, Putzbrunn; Julius Huebl, Munich, both of Fed. Rep. of Germany

[73] Assignee: Carl Hurth Maschinen- und Zahnradfabrik, Munich, Fed. Rep. of Germany

[21] Appl. No.: 841,199

[22] Filed: Oct. 11, 1977

[30] Foreign Application Priority Data

Dec. 18, 1976 [DE] Fed. Rep. of Germany ..... 2657575

[51] Int. Cl.[3] ..... B61C 9/50; B61C 17/00; B61F 3/04; F16C 1/06

[52] U.S. Cl. ..... 105/136; 64/1 C; 74/609; 105/140; 277/30; 277/100; 308/36.1; 403/286

[58] Field of Search ..... 64/1 C; 74/609; 105/131, 133, 134, 135, 136, 137, 138, 139, 140; 277/30, 100; 403/286, 293

[56] References Cited

U.S. PATENT DOCUMENTS

| | | | |
|---|---|---|---|
| 1,063,389 | 6/1913 | Robbins | 277/100 |
| 1,723,720 | 8/1929 | Buchli | 105/133 X |
| 1,813,140 | 6/1931 | Bethel | 105/139 |
| 2,084,891 | 6/1937 | Cease | 105/136 |
| 2,847,837 | 8/1958 | Baker | 277/30 X |
| 3,239,232 | 3/1966 | Andresen | 277/30 |
| 3,727,483 | 4/1973 | Hanson et al. | 105/140 X |
| 3,797,329 | 3/1974 | Quirk | 74/609 |
| 4,135,453 | 1/1979 | Koch et al. | 105/136 |
| 4,228,739 | 10/1980 | Fitzgibbon | 105/136 |

*Primary Examiner*—Joseph F. Peters, Jr.
*Assistant Examiner*—Howard Beltran
*Attorney, Agent, or Firm*—Blanchard, Flynn, Thiel, Boutell & Tanis

[57] ABSTRACT

A parallel drive shaft arrangement for rail vehicles wherein the output shaft of the electric motor is arranged parallel to the axle. The electric motor effects a driving of the axle through a gear arrangement and a toothed coupling. One side of the gear arrangement is supported on the axle and both the gear arrangement and the motor are connected through pivot levers to the vehicle frame. The electric motor is secured to the gear housing through a rubber-ring spring device surrounding the toothed coupling.

12 Claims, 3 Drawing Figures

RESILIENT RAILWAY TRUCK ARTICULATED SHAFT HOUSING

FIELD OF THE INVENTION

The invention relates to a parallel shaft drive arrangement and, more particularly, relates to a parallel drive shaft arrangement having a rubber ring-spring device positioned around a toothed coupling and between the connecting structure which connects the motor to the gear housing so that relative movement can occur between the motor and the gear housing.

BACKGROUND OF THE INVENTION

The most known and most used parallel shaft drives are the so-called nose-suspended drive and the so-called frame drive. In the case of the first one, the electric motor is supported at one end by means of at least one correspondingly designed arm on the driving axle driven thereby through a gear drive arrangement, while it is connected at the other end to the vehicle or bogie frame. Thus, the motor and the gear arrangement belong only in part to the spring-loaded masses. In the case of the so-called frame drive, the motor is fixedly connected to the vehicle or bogie frame and thus is part of the spring-loaded part of the vehicle. For this reason the interpositioning of an all around movable coupling is needed between the motor and the driving axle.

Both drive systems have certain disadvantages. In the case of the nose-suspended drive, it is the support on the driving axle which presents problems in servicing and during a removal of the driving axle. In the case of the frame drive, it is the coupling that is considered to be disadvantageous because of both the need for space and also because of the plurality of individual parts which have a partly complicated form.

In order to avoid the known disadvantages of the conventional parallel shaft drive, drives have been developed lately which have the following structure: The motor is secured at the back thereof to the gear housing supported on the driving axle through roller bearings. The bearings can thereby be positioned either directly on the shaft or, however, on the lateral hubs of the driven gear fixedly connected to the drive shaft. Both the end of the gear arrangement, which is opposite the drive shaft, and also the free end of the motor are connected to the vehicle or bogie frame. It is obvious that in this arrangement provisions must be made in order to permit a limited amount of relative movement between the gear arrangement and the motor.

Therefore the basic purpose of the invention is to develop a parallel shaft drive of the above-described type, in which the connection between the electric motor and the gear arrangement can absorb large forces, which for example stem from the weight of the motor (radially acting) and from the torque (acting in the peripheral direction), however, at the same time permits with simple means angular deflections between these two aggregates while remaining substantially rigid in axial direction or in peripheral direction.

SUMMARY OF THE INVENTION

The objects and purposes of the invention are met by providing in a parallel shaft drive arrangement an electric motor having an output shaft arranged parallel to the axle and connected through a toothed coupling to a gear arrangement for effecting a driving of the axle. One side of the gear arrangement is supported on the driving axle and both the gear arrangement and also the motor are each connected at their free end through pivot levers to the vehicle frame. The electric motor is secured to the gear housing through a rubber-ring spring device which surrounds the toothed coupling.

Further advantages and characteristics of the invention can be taken from the following description.

BRIEF DESCRIPTION OF THE DRAWINGS

The invention is discussed with reference to one exemplary embodiment illustrated in FIGS. 1 to 3.

DETAILED DESCRIPTION

Figure 1:
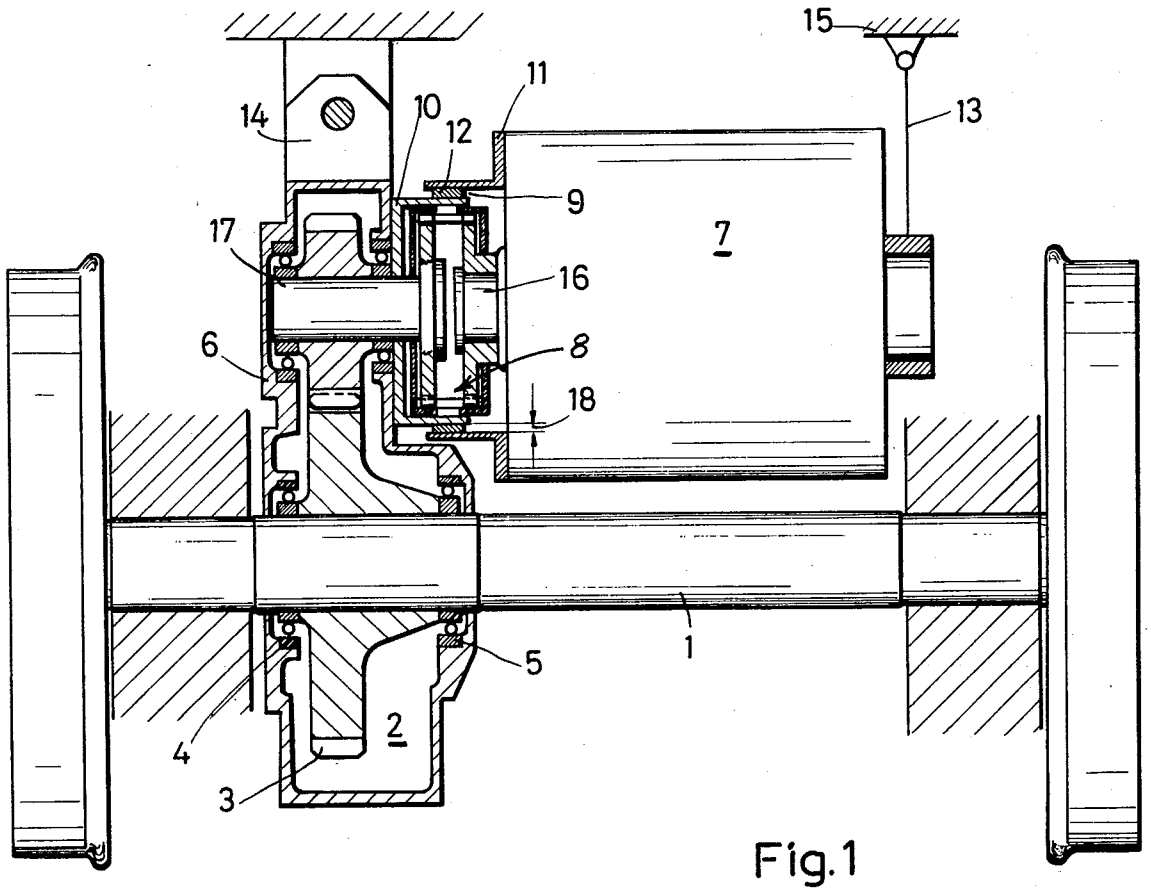
FIG. 1 illustrates in a simplified manner the structure of a parallel shaft drive according to the invention.

FIG. 1 illustrates in a simplified manner the arrangement of a parallel shaft drive according to the invention in an example of a driving gear set which is supported on the inside. However, the invention can be applied also without any change in the case of an outside support. The larger gear 3 of a single-step or multi-step gear arrangement 2 is fixedly mounted in a suitable manner on the driving axle 1. Bearings 4, 5 are arranged adjacent the axial ends of its central hub or next thereto on the driving axle 1. The outer races of these bearings support the gear housing 6. The gear arrangement is driven by an electric motor 7 which is arranged parallel to the driving axle 1 through a conventional toothed coupling 8. The toothed coupling is surrounded by a rubber-ring spring device 9 consisting of a first metallic ring part 10 radially inwardly spaced from second metallic ring part 11 and an annular part 12 made of rubber or the like sandwiched therebetween and vulcanized thereto. One of the two ring parts 10, 11 is secured to the gear housing 6 and the other one to the motor 7. The opposite end of the motor is connected through at least one pivotal lever 13, which lies in the drawing plane, and at least one further pivotal lever which is arranged perpendicularly thereto and which is not shown, to the vehicle or bogie frame 15. The gear housing 6 has a plate 14 which for example is casted thereon for receiving a pivotal lever also not shown and which is oriented perpendicularly with respect to the drawing plane, through which pivotal lever the gear arrangement is connected to the vehicle or bogie frame.

This type of the suspension of the motor-gear arrangement-assembly permits together with the toothed coupling 8 angular displacements between the motor shaft 16 and a first gear shaft 17 defining the input shaft to the gear arrangement. The magnitude of the possible angular displacement depends substantially on the design of the toothed coupling 8 and the cross section of the rubber ring 12 and from the hardness of the utilized rubber or the like. The larger the radial thickness 18 of the rubber ring 12, the larger may be the possible angular displacement. However, at the same time the rubber-ring spring has the tendency to permit undesired relative movements between the motor and gear arrangement both in the longitudinal direction and also in the peripheral direction, in each case reference being made to the motor axis. The optimum design criteria must be made based upon the existing conditions.

Figure 2:
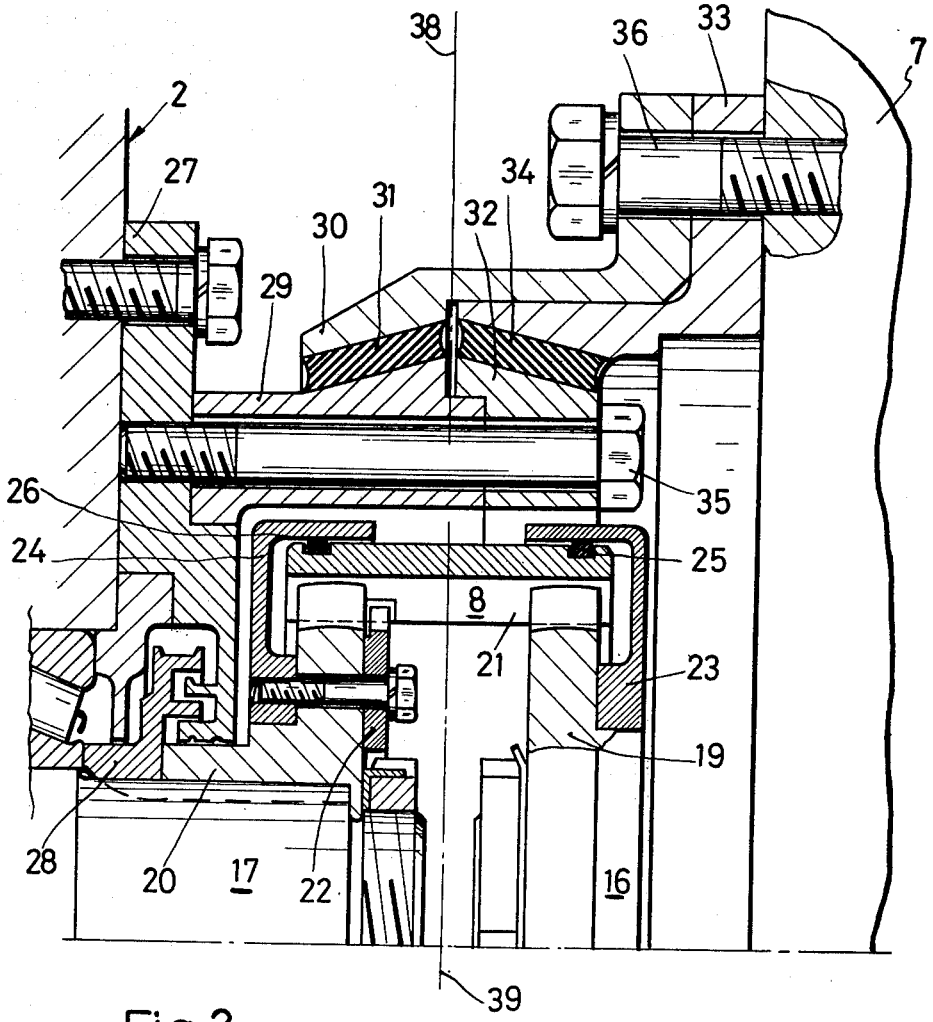
FIG. 2 is a cross-sectional view of the connection between the motor and gearing in the normal condition with an initially tensioned two-part rubber-ring spring.
Figure 3:
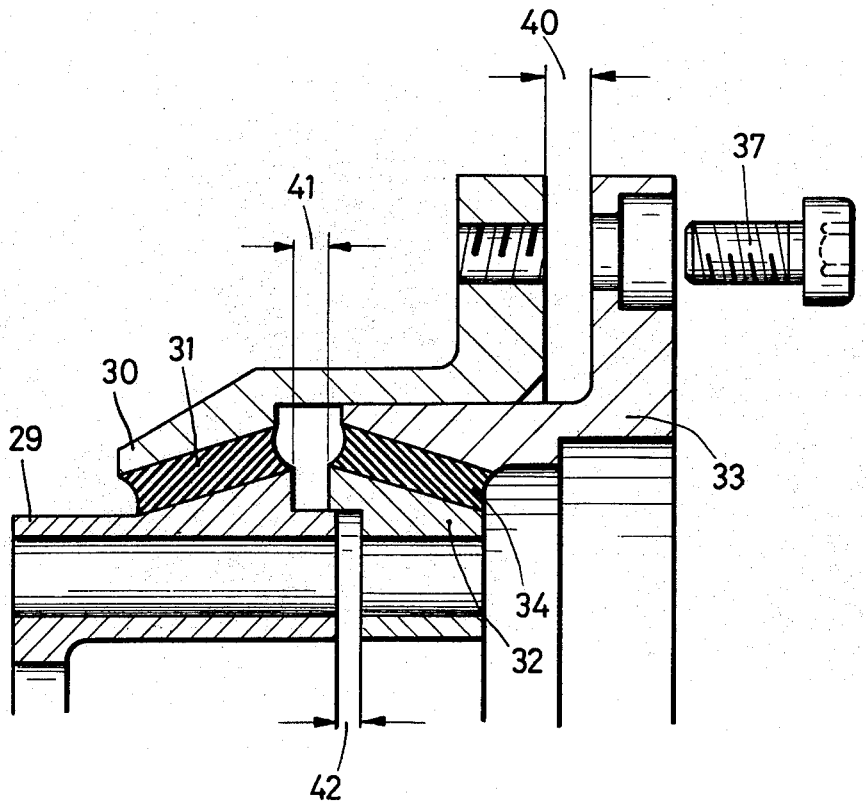
FIG. 3 illustrates the condition of the rubber-ring spring prior to the installation.

A further and preferable development of the invention is to construct the rubber-ring spring in two parts and to limit the rubber rings to a conical or spherical shape and to initially tension same. This construction is illustrated in FIG. 2. Toothed inner coupling parts 19 and 20 are mounted in a suitable manner on the ends of substantially aligned shafts 16 and 17 of motor 7 and gear arrangement 2, respectively, which ends face one another. The teeth of the two inner parts 19 and 20 which are connected with one another through the toothed outer coupling part 21 are constructed advantageously spherically. To axially secure the outer part 21, conventional means are provided, for example a plate 22 which projects into an annular groove and is secured to an inner coupling part. To prevent the lubricating grease which has been introduced during installation from escaping, gaskets 23 and 24 and O-rings 25 and 26 or the like are provided. The gear arrangement 2 is equipped with further conventional means to prevent the loss of lubricant, for example a lid 27 secured to the housing 6 and a ring 28 which is engaged with the shaft 17 and forms a labyrinth type seal with each other. Of course, it is possible to utilize also any other type of seal, for example commercial shaft-packing rings. The toothed coupling 8 which consists substantially of the inner coupling parts 19 and 20, the outer coupling part 21 and the gaskets 23, 24 is surrounded by the rubber-ring spring device 9. Same consists first (FIG. 1) of a first and second metallic ring part 10 and 11 and a ring 12 made of rubber or the like sandwiched therebetween and vulcanized thereto. In order to increase the durability of the rubber ring 12 which absorbs the angular deflections occurring during operation between motor and gear arrangement, the ring 12 is pretensioned in axial direction. This is possible by dividing the rubber-ring coupling along a plane 38 which lies transversely to its longitudinal axis (FIG. 2). A first inner ring part 29 and a first outer ring part 30 are connected through a ring 31 made of rubber or the like which is vulcanized thereinbetween and in the same manner a second inner ring part 32 and a second outer ring part 33 are coupled through a ring 34 which is vulcanized thereinbetween. The said prestress is possible as long as the distances 40 and 41 are larger than the distance 42 (FIG. 3). If the rings 31, 34 are conically limited on the inside and/or outside, then during assembly of the two rubber-ring spring elements 29+30+31, 32+33+34 an axial prestress and in opposite axial directions is possible. The inner ring parts 29, 32 of the rubber-ring spring elements are secured together with screws 35 to the lid 27 (FIG. 2) or to the gear housing. The associated outer ring parts 30, 33 are also mounted on the motor 7 through common screws 36. It is thereby possible for the screws 36 to simultaneously prestress the rubber rings 31, 34, however, it is also possible to use separate screws 37 to bring about a prestress, which makes for an easier assembly of the motor and the gear arrangement. It is understood that with a suitable design the rubber-ring springs can also be constructed in a reversed manner, namely the inner rings can be connected to the motor and the outer rings to the gear arrangement.

Figure 2A:
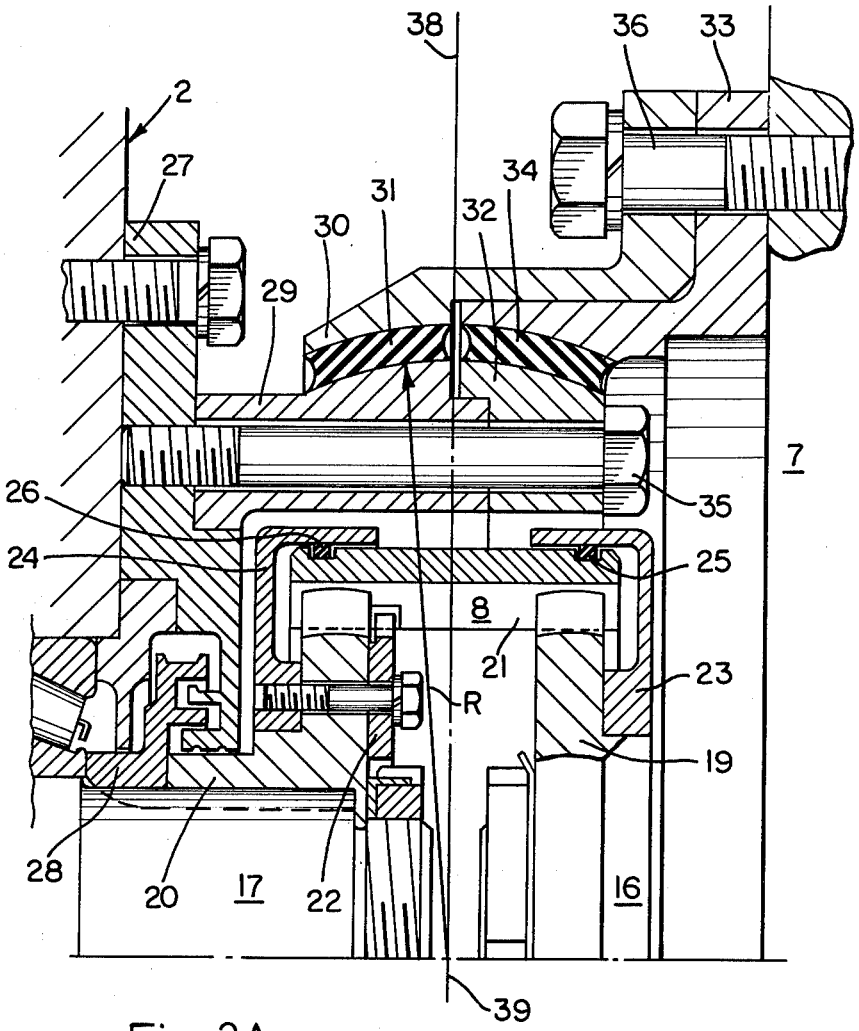
FIG. 2A is a cross-sectional view of a modified rubber-ring spring construction.

If desired, the rubber rings 31, 34 can be prestressed by initially having on the inside surfaces thereof a concave surface whereas the outside surfaces have a convex surface as shown in FIG. 2A. The center point of the concave and convex surfaces is positioned at or closely adjacent the point of intersection of the axis of the motor output shaft and the central plane 38 of the rubber-ring spring device 9 as shown by the radius R.

A particularly favorable arrangement of the rubber-ring spring device exists in that its central plane 38 which lies transversely with respect to the longitudinal axis is substantially identical to the central plane 39 of the toothed coupling 8. The rubber-ring spring device forms a type of a joint which permits angular movements between the motor 7 and the gear arrangement 2. If the fulcrum point of this joint lies now in the center of the toothed coupling, then the toothed coupling needs to balance out only angular deflections between the motor shaft 16 and the first gear shaft 17. If, however, the fulcrum point of the joint which is formed by the rubber-ring spring would be arranged offset toward the center of the toothed coupling, then the toothed coupling would have to balance out in addition yet radial axle misalignments when angle errors exist between the two shafts or occur automatically during operation. These axle misalignments would become larger with an increasing distance of the fulcrum point from the clutch center.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A parallel shaft drive mechanism, in particular for driving an axle of rail vehicles, comprising:

a drive motor having an output shaft arranged parallel to said driving axle and substantially next to same;

a toothed coupling having an input member and an output member, said input member being connected to said output shaft;

a gear arrangement in a gear housing connected to said output member for facilitating a driving of said axle, one side of said gear housing being supported on said driving axle, and the other side of both said gear housing and also said motor being each connected to one end of separate pivot levers, the other ends of said pivot levers being connected to a frame member of said vehicle;

a resilient spring device surrounding said coupling means and resiliently connecting said gear housing and said motor to thereby facilitate an absorption of angular deflections between said output shaft of said motor and axle during operation, said resilient spring device being divided into a first means fixedly connected to said gear housing and a second means fixedly connected to said motor and at least two axially aligned and axially spaced elastic material rings, each elastic material ring being fixedly connected on one side thereof to said first means and on the other side thereof to said second means; and means for effecting an axial pretensioning of said two elastic material rings.

2. The parallel shaft drive mechanism according to claim 1, wherein said motor is an electric motor.

3. The parallel shaft drive mechanism according to claim 1, wherein said axial pretensioning means includes means for effecting said pretensioning in opposite axial directions.

4. The parallel shaft drive mechanism according to claim 1 wherein said elastic material rings are rubber and wherein said fixed connection of said rubber rings to said first means and said second means is a vulcanized connection.

5. The parallel shaft drive mechanism according to claim 1, wherein said first means consists of two first ring members and means for connecting same to said gear housing, wherein said second means consists of two second ring members and means for connecting same to said motor, wherein the pair of said first ring members is coaxially oriented and each is spaced radially from and radially aligned with a corresponding one of the pair of said second ring members, said second ring members being also coaxially oriented, wherein said two elastic material rings are each fixedly secured to an associated one of said first ring members and a second ring member radially aligned therewith.

6. The parallel shaft drive mechanism according to claim 5, wherein during assembly an initial first axial spacing exists between one of said pairs of said first and second ring members and an initial second axial spacing exists between the other of said pairs of said first and second members, said first axial spacing being greater than said second axial spacing, wherein said pretensioning means includes means for closing said initial first and second axial spacings, said second axial spacing closing first, a continued closing of said first axial spacing effecting said axial pretensioning of said two elastic material rings.

7. The parallel shaft drive mechanism according to claim 1, wherein a plane perpendicular to the axis of rotation of said output shaft of said motor and said input shaft to said coupling means is oriented centrally between said two axially spaced elastic material rings and contains the geometric center of said coupling means.

8. The parallel shaft drive mechanism according to claim 7, wherein each of said elastic material rings has a conical surface on the inside and outside thereof.

9. The parallel shaft drive mechanism according to claim 7, wherein said elastic material rings have on the inside concave and on the outside convex surfaces, the center points of which lie adjacent the point of intersection of said axis of rotation of said output shaft of said motor and said central plane between said two elastic material rings.

10. A railway motor mounting system comprising:

a truck frame supported on a wheel and axle set;

a gear box comprising a plurality of gears in a drive train coupled to directly drive the axle, said plurality including a pinion gear having an input shaft positioned adjacent one end of the gear box and connected to a drive gear attached to the axle;

means supporting said one end of the gear box from the truck frame, the other end being supported on the axle by anti-friction bearing;

a traction motor having a housing and an output shaft parallel to the axle and a flexibly coupled to drive the pinion gear shaft;

first motor support means mounting the rearward end of the motor housing remote from said output shaft to the truck frame;

second motor support means mounting the forward end of the motor housing adjacent the output shaft to the gear box, said second support means comprising a flexible joint surrounding said shafts and extending between the gear box and the housing of the traction motor, said flexible joint being divided into two parts and consisting of at least two axially aligned and axially spaced elastic material rings, each elastic material ring being fixedly connected on one side thereof to one of two first coupling means, each of which is connected to said gear box and on the other side thereof to one of two second coupling means, each of which is connected to said motor;

means defining an initial axial spacing between said first and second coupling; and means for drawing said first and second coupling means together to effect an axial pretensioning of said two elastic material rings between the respective ones of said first and second coupling means.

11. The parallel shaft drive mechanism according to claim 10, wherein said axial pretensioning means includes means for effecting said pretensioning in opposite axial directions.

12. The parallel shaft drive mechanism according to claim 10, wherein said elastic material rings are rubber and wherein said fixed connection of said two rubber rings to said first coupler means and said second coupling means is a vulcanized connection.

* * * * *